US008839652B2

(12) United States Patent
Kondo et al.

(10) Patent No.: US 8,839,652 B2
(45) Date of Patent: Sep. 23, 2014

(54) METHOD AND DEVICE FOR PRESS-HARDENING A METALLIC FORMED STRUCTURE

(75) Inventors: Kiyohito Kondo, Paderborn (DE); Friedrich Bohner, Oerlinghausen (DE); Martin Pohl, Altenbeken (DE); Robert Stockter, Hannover (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 809 days.

(21) Appl. No.: 12/561,401

(22) Filed: Sep. 17, 2009

(65) Prior Publication Data

US 2010/0064759 A1 Mar. 18, 2010

(30) Foreign Application Priority Data

Sep. 18, 2008 (DE) ..... 10 2008 047 971

(51) Int. Cl.

| | |
|---|---|
| ***B21D 22/00*** | (2006.01) |
| ***B21D 22/20*** | (2006.01) |
| ***B21D 22/22*** | (2006.01) |
| ***B21D 24/16*** | (2006.01) |
| ***C21D 8/02*** | (2006.01) |
| ***C21D 1/673*** | (2006.01) |
| ***C21D 1/18*** | (2006.01) |
| ***B21D 37/16*** | (2006.01) |

(52) U.S. Cl.

CPC ..... *B21D 37/16* (2013.01); *B21D 22/208* (2013.01); *B21D 22/22* (2013.01); *B21D 24/16* (2013.01); *C21D 8/02* (2013.01); *C21D 1/673* (2013.01); *C21D 1/18* (2013.01)

USPC ..... 72/350

(58) Field of Classification Search

USPC ..... 72/342.1–342.3, 342.7, 342.94, 347, 72/364, 350, 351

See application file for complete search history.

(56) References Cited

U.S. PATENT DOCUMENTS

| | | | | |
|---|---|---|---|---|
| 3,584,487 | A * | 6/1971 | Carlson | 72/38 |
| 3,703,093 | A * | 11/1972 | Komatsu et al. | 72/342.4 |
| 4,365,499 | A * | 12/1982 | Hirota et al. | 72/351 |
| 6,276,185 | B1 * | 8/2001 | Owens | 72/350 |

(Continued)

FOREIGN PATENT DOCUMENTS

| | | |
|---|---|---|
| DE | 102 54 695 B3 | 4/2004 |
| DE | 102004059598 | 6/2006 |
| JP | 52-35756 | 3/1977 |
| WO | WO 2006/057196 | 6/2006 |

*Primary Examiner* — Shelley Self
*Assistant Examiner* — Matthew G Katcoff
(74) *Attorney, Agent, or Firm* — Henry M Feiereisen LLC

(57) ABSTRACT

In a method for press-hardening a metallic formed structure made of a hardenable steel sheet, the steel sheet is heated above a transition temperature Ac3 and then placed in a cooled press having a forming tool with at least one uncooled contour section for forming a region of reduced hardness. Marginal regions of the steel sheet are clamped with a sheet holder arrangement which has an inner sheet holder and an outer sheet holder. The inner sheet holder is hereby located closer to the forming tool than the outer sheet holder. The sheet holder arrangement is configured to slow down flow of the marginal regions into the forming tool. After closing the press tool, the steel sheet is formed in a first forming phase by holding the marginal region with the outer sheet holder and in a subsequent forming phase by holding the marginal region with the inner sheet holder.

9 Claims, 7 Drawing Sheets

(56) References Cited

U.S. PATENT DOCUMENTS 6,742,374 B2 * 6/2004 Ozawa ..... 72/342.5
2007/0175258 A1 * 8/2007 Bowen ..... 72/347
2008/0098789 A1 * 5/2008 Hori et al. ..... 72/349
2008/0196800 A1 * 8/2008 Beenken et al. ..... 148/643

* cited by examiner

METHOD AND DEVICE FOR PRESS-HARDENING A METALLIC FORMED STRUCTURE

CROSS-REFERENCES TO RELATED APPLICATIONS

This application claims the priority of German Patent Application, Serial No. 10 2008 047 971.3, filed Sep. 18, 2008, pursuant to 35 U.S.C. 119(a)-(d), the content of which is incorporated herein by reference in its entirety as if fully set forth herein.

BACKGROUND OF THE INVENTION

The present invention relates to a method for press-hardening a metallic formed structure made of a hardenable steel sheet, and to a device for carrying out the method.

The following discussion of related art is provided to assist the reader in understanding the advantages of the invention, and is not to be construed as an admission that this related art is prior art to this invention.

German Pat. No. DE 102 54 695 B3 describes a production of a metallic formed structure, in particular a chassis structure, from an unhardened, hot-formable steel sheet by initially shaping a semi-finished product through cold-forming, in particular through deep-drawing, to a structure blank, which is subsequently cut at the edges to an edge contour that approximates the contour of the structure. This cut blank is subsequently press-hardened in a hot-forming tool. This process suffers shortcomings, when high-strength press-hardened steels are involved which typically do not permit deep-drawling of complex structures without a hold-down device or sheet holder so as to prevent the formation of wrinkles when the sheet metal is drawn into the female die. The sheet holders can also be provided with a cooling device. However, the edge regions of the steel sheet are then also hardened, resulting in increased wear of the cutting tools used to subsequently cut the press-hardened structures to size. It would be desirous to provide the press-hardened structure with an edge region where the press-hardened structure is softer or has a smaller hardness. The pressed structure could then be cut in this region without causing increased tool wear of the cutting tools. However, such partially soft regions cannot be formed with conventional sheet holders, because those regions which are drawn inwardly into the female die during the forming process make prior contact with the cooled sheet holders and are therefore hardened. Very high-strength materials can then attain a hardness greater than 1,500 MPa in the marginal regions. Such high-strength materials can be cut to size only in a very complex manner.

It would therefore be desirable and advantageous to address prior art shortcomings and to provide an improved method and device for press-hardening a metallic formed structure which is suitable for implementing partially unhardened regions also in the marginal region of the press-hardened steel sheet, even if these regions are arranged in the region of cooled sheet holders at the beginning of the forming process.

SUMMARY OF THE INVENTION

According to one aspect of the present invention, a method for press-hardening a metallic formed structure made of a hardenable steel sheet includes the steps of heating the steel sheet above a transition temperature Ac3, placing the heated steel sheet in a cooled press having a forming tool with at least one uncooled contour section for forming a region of reduced hardness, clamping marginal regions of the steel sheet with a sheet holder arrangement, with the sheet holder arrangement having an inner sheet holder and an outer sheet holder, wherein the inner sheet holder is located closer to the forming tool than the outer sheet holder, wherein the sheet holder arrangement is configured to slow down flow of the marginal regions into the forming tool, and closing the press tool for forming the steel sheet by holding the marginal region with the outer sheet holder in a first forming phase and holding the marginal region with the inner sheet holder in a subsequent forming phase.

According to another aspect of the present invention, a device for press-hardening a metallic formed structure made of a hardenable steel sheet includes a forming press having a forming tool, and a sheet holder arrangement comprising an inner sheet holder and an outer sheet holder, wherein the inner sheet holder is located closer to a forming tool of the press than the outer sheet holder, and wherein the sheet holders contact the steel sheet with a time offset.

With the method of the invention for press-hardening a metallic formed structure made of a hardenable steel sheet, the steel sheet is initially heated to a temperature above its transition temperature Ac3, which is defined as the temperature at which transformation of ferrite into austenite is completed upon heating. The steel sheet is converted into austenite to enable hardening.

It should be noted that the steel sheet can theoretically already be a preform. However, the steel sheet is preferably planar.

The heated steel sheet is inserted into a cooled press, wherein a female die has at least one uncooled contour section for realization of a region of reduced hardness. The cooled press is used for both hot-forming and hardening. However, the workpiece is only partially hardened. There always remains an uncooled contour section for forming a region of reduced hardness.

The term "uncooled contour section" relates to a contour section of the female die which is not intended to promote hardening the steel sheet, but rather prevents or reduces hardening. This requires at least that the contour section is thermally isolated from the cooled sections. The cooled section can also be additionally heated and provided with corresponding heating means.

Such a steel sheet is typically clampingly fixed by sheet holder arrangements disposed along the edge of the female die. Sheet holder arrangements are arranged on at least two longitudinal sides of the steel sheet to be shaped. The press is subsequently closed, i.e. a plunger of the forming tool is moved towards the female die. The marginal regions of the steel sheet are fixed by the sheet holder arrangements shortly before the plunger urges the steel sheet into the female die, wherein the sheet holder arrangements slow down the flow of the marginal regions of the steel sheet into the female die.

Importantly, a marginal sheet holder arrangement has an inner sheet holder and an outer sheet holder, wherein the inner sheet holder is located closer to the female die than the outer sheet holder. The term "inner" refers to the center region of the press tool. The term "outer" according to the invention relates to the region that is farther removed and faces away from the press tool/the female die.

According to the method of the invention, a marginal region is held by the outer sheet holder in a first forming phase and by the inner sheet holder in a subsequent forming phase. As a result, each sheet holder arrangement has thus two sheet holders which operate, i.e., come into contact with the marginal region, with a time offset. It will hereby be assumed that generally a portion of the marginal region is still held by the sheet holders until the forming process is concluded.

The steel sheet is drawn further and further inward during forming, so that at the end of the forming process the marginal region is no longer held by the outer sheet holder, but rather by the inner sheet holder. The outer cooled sheet holder therefore never contacts a region of the sheet that is located between the outer side of the female die and the outer sheet holder. This region is essentially freely drawn into the female die and is therefore also not cooled by contact with the sheet holder. At the end of the forming process, this uncooled and hence unhardened region is located in the uncooled contour section of the female die, making it possible to intentionally form a region with reduced hardness, which is subsequently cut to size with significantly less difficulty after the press-hardened formed structure has been removed from the press.

Importantly, after the region with the decreased hardness is moved into the female die, the second inner sheet holder is additionally engaged, clamping the marginal region that is already in contact with the outer sheet holder. This region of the steel sheet is already hardened through contact with the outer sheet holder and finally forms the region that is subsequently separated from the formed structure. Additional contact with the cooled sheet holder is not damaging in this region.

The sheet holders of a sheet holder arrangement are employed time-sequentially. The inner sheet holder is hereby brought into contact with the steel sheet only after the portion of the marginal region which is later located in the uncooled contour section has been withdrawn from the region of the inner sheet holder. This does not mean that the marginal region is not always held by the sheet holder. Rather, the width of the marginal region is dimensioned so that either the outer or the inner sheet holder holds the marginal region. The time intervals during which both sheet holders make contact with the marginal region can overlap.

Within the context of the invention, more than a single inner sheet holder and a single outer sheet holder can be provided. For example, at least one additional center sheet holder can be arranged between the inner and the outer sheet holder, wherein the center sheet holder is brought time-wise into contact with the marginal region after the outer sheet holder, but before the inner sheet holder. Even if three or more sheet holders were sequentially arranged, the sheet holders are always controlled in such a way that none of the sheet holders comes into contact with the particular marginal region which is later located in the uncooled contour section. However, after the region that is to be kept soft is withdrawn from the effective region of a sheet holder, the particular sheet holder located closest to the female die can be closed, i.e., initially the center sheet holder or one of the center sheet holders followed by the inner sheet holder.

Each sheet holder is composed of an upper holder and a lower holder, wherein the upper and lower holders of the outer sheet holder can be moved independently of the upper and lower holders of an inner holder or a center sheet holder. Accordingly, each holder can be separately controlled.

Of course, it is also conceivable that a holder of the outer sheet holder is configured as a resistance holder which is formed in one piece with the female die. When the press tool is closed, an upper or lower holder is pressed against a marginal section of the female die body surrounding the female die. In this embodiment, one holder of the inner sheet holder is inherently supported in the female die body. To prevent contact with the steel sheet at the beginning of the forming process, this holder of the inner sheet holder is initially detached from the steel sheet and is only brought into contact with the steel sheet when the region of the steel sheet that is to be kept soft is drawn into the female die.

In general, all sheet holders are cooled by incorporating corresponding cooling channels in the sheet holders.

At the end of the forming process, the press-hardened formed structure can be cut to size by first removing the formed structure from the opened press tool. The formed structure has a cutting edge which extends at least partially, but preferably entirely, in the softer region which is generated or maintained in the uncooled contour section of the press tool.

The method of the invention can be used, for example, to produce B-pillars for a motor vehicle chassis from ultra-high-strength steel by hot-forming and press-hardening. Tensile strengths in excess of 1,500 MPa can be obtained, wherein the marginal regions can be cut in a manner that reduces tool wear.

The method of the invention can be carried out on a device for press-hardening of a metallic formed structure made of a hardenable steel sheet. This device includes a press tool which can be integrated in a forming press, and a sheet holder arrangement having an inner sheet holder and an outer sheet holder. The inner sheet holder is located closer to the female die than the outer sheet holder, wherein the sheet holders can be time-sequentially brought into contact with the steel sheet. This time offset is to be realized even when at least one additional sheet holder is arranged between the outer sheet holder and the inner sheet holder, which can be brought time-wise into contact with the steel sheet after the outer sheet holder, but before the inner sheet holder. Each of these sheet holders can be divided into an upper holder and a lower holder, which can be moved independently of the holders of the respective other sheet holder. Because the outer sheet holder is inherently closed first, a holder of the outer sheet holder can also be implemented as a stationary resistance holder. The other holders of the inner sheet holder or of the additional center sheet holder(s) must be movable at least with respect to the stationary pressure pads. The sheet holders are cooled and hence provided with corresponding cooling channels.

In general, all sheet holders can have the same width so that they hold an equally wide sheet strip of the marginal region. However, in particular the outer sheet holder may also be wider than a sheet holder located farther inward. Accordingly, the holding force of the outer sheet holder may be greater than a holding force of the inner sheet holder. This is also due to the fact that initially the outer sheet holder alone is used, whereas the inner sheet holder is effectively engaged at a later time instance, so that the marginal region is partially fixed by the outer sheet holder and also partially fixed by the inner sheet holder. The holding force of the inner sheet holder or of a center sheet holder can therefore be smaller than the holding force of the outer sheet holder.

With the method and the device of the invention, partially soft regions can be produced on complex metallic deep-drawn products, for example B-pillars of a motor vehicle, which unavoidably require the use of sheet holders during hot-forming. Although the hot-forming process and the tools employed in this process are quite expensive, the overall costs are lower as a result of cost savings during the subsequent cutting after hot-forming.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
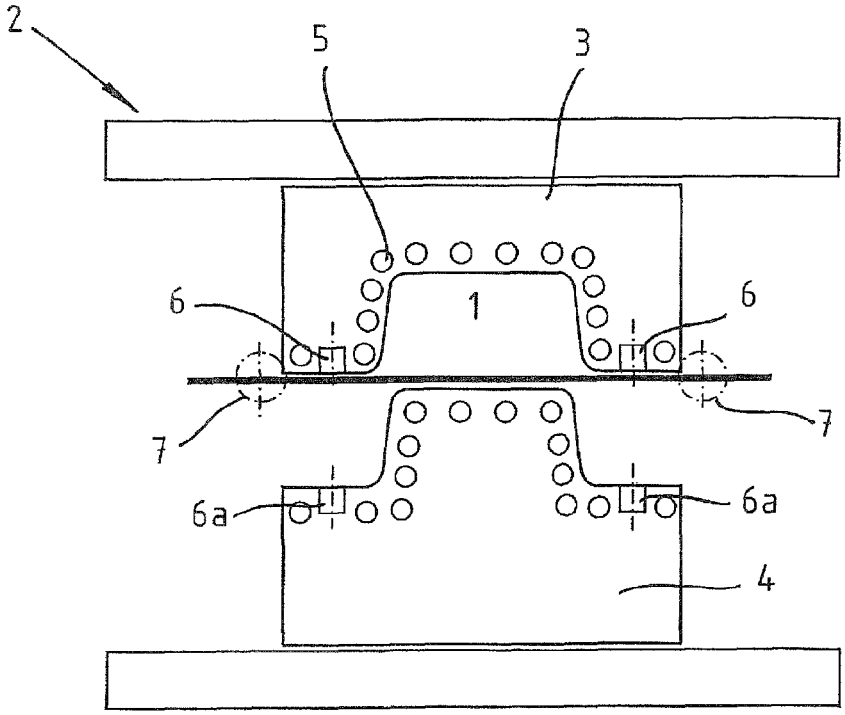
FIGS. 1 and 2 show a schematic illustration of an example of a device for form-hardening a metallic formed structure without using a hold-down device.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
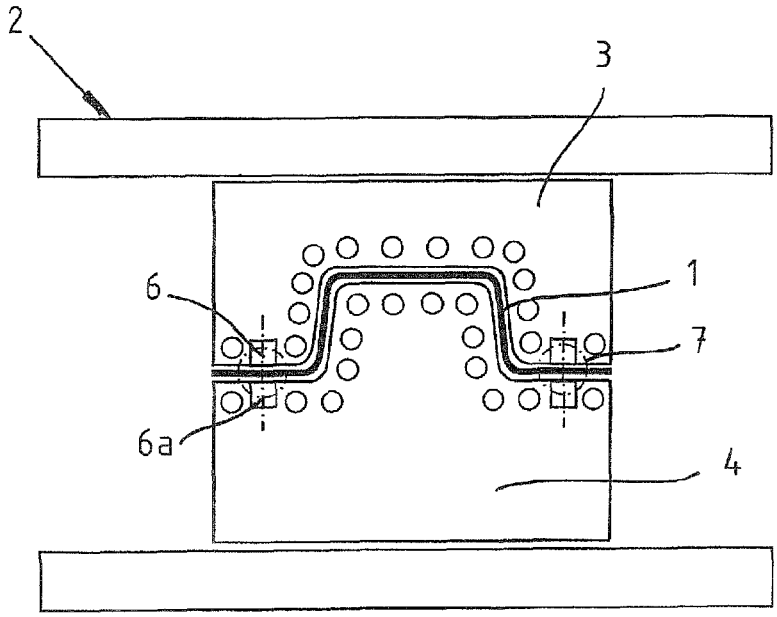

Turning now to the drawing, and in particular to FIG. 1, there is shown a schematic illustration of an example of a device for form-hardening a metallic formed structure without a hold-down device. FIG. 1 shows hereby a first step of a production process for producing the metallic formed structure. A steel sheet 1 is heated to a temperature above its transition temperature Ac3, i.e., transformed into the austenitic phase. The heated steel sheet 1 is placed in a press tool 2. The press tool 2 is composed of an upper forming tool 3 and a lower forming tool 4. The upper forming tool 3 is formed as a female die. The lower forming tool 4 is configured as a plunger. The forming tools 3, 4 are cooled through cooling ducts of a cooling system 5, with a coolant being supplied through the ducts. The cooling system 5 extends over almost the entire contour of the upper forming tool 3 and the lower forming tool 4, respectively, except for an uncooled contour section 6, 6*a* in the upper forming tool 3 and in the lower forming tool 4. The uncooled contour sections 6, 6*a* are located opposite from one another, so that a steel sheet 1 contacting the contour of the forming tools 3, 4 in this region is cooled down less rapidly and therefore has a smaller hardness than the adjacent regions. The region of the steel sheet 1 which is to have a smaller hardness, i.e. which will be softer than the surrounding regions, is the encircled region 7 which is initially outside the press tool 2 and is located in the region of the uncooled contour sections 6, 6*a* at the end of the forming process, as shown in FIG. 2. This exemplary embodiment does not employ a sheet holder or hold-down device, so that the material flow of the steel sheet 1 is not slowed down or controlled. If the material flows too quickly, wrinkles are produced due to tangential compressive stress. With the approach described in FIGS. 1 and 2, more complex geometries will necessarily include wrinkles.

Figure 3:
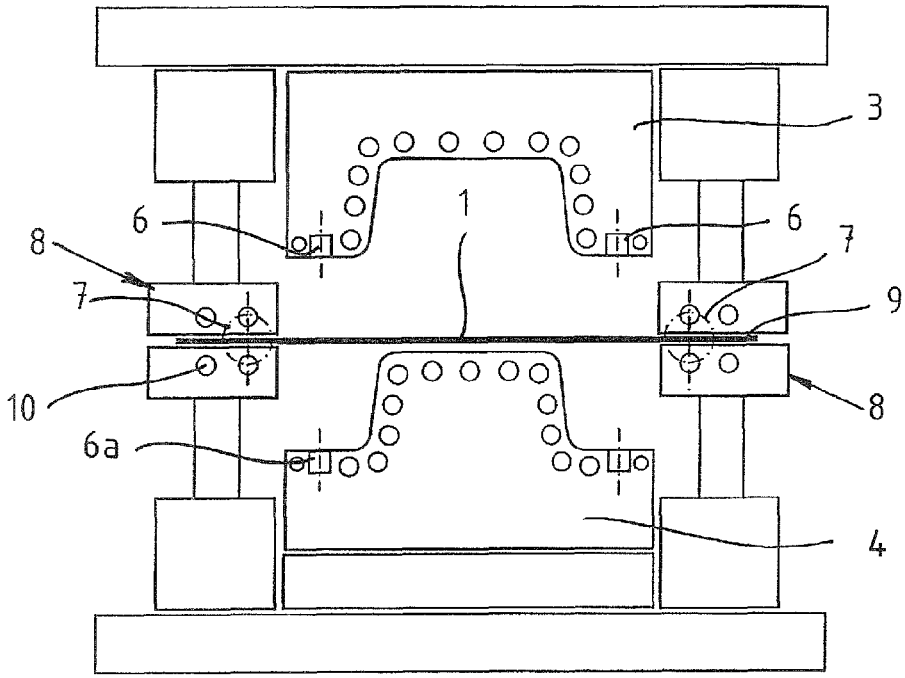
FIGS. 3 and 4 show a schematic illustration of a modification of the example of FIGS. 1 and 2, however with a hold-down device.
Figure 4:
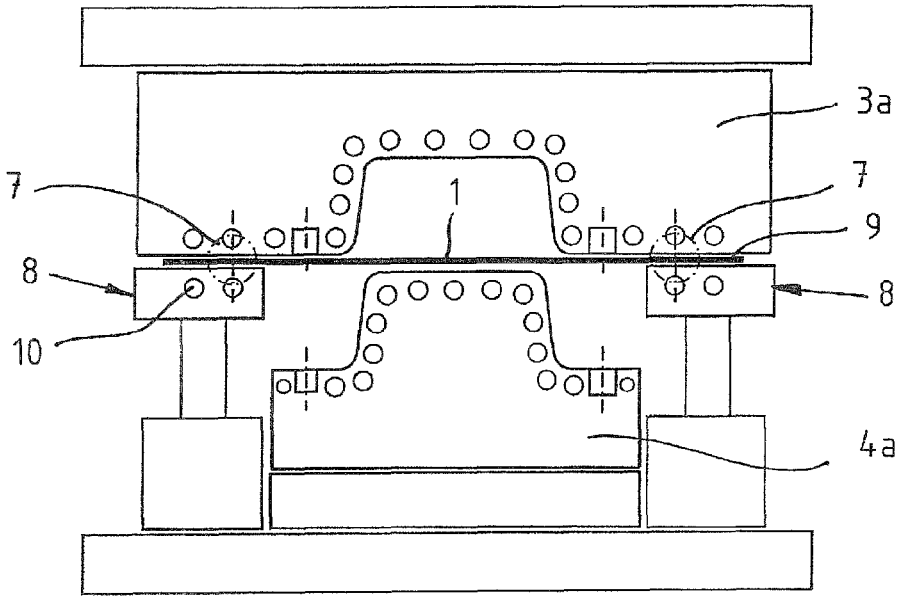

To slow down or control the material flow, sheet holders or hold-down devices are required, which are illustrated in the exemplary embodiments of FIGS. 3 and 4. However, these exemplary embodiments also do not form part of the invention, but are merely intended to illustrate the disadvantages caused by using conventional hold-down devices or sheet holders. The example of FIG. 3 shows that the sheet holders 8 clampingly hold marginal regions 9 of the steel sheet 1 to be formed. The region 7, which should later have a reduced hardness, is located in the region of the sheet holder 8. The sheet holders 8 are also connected with a cooling system 10 and promote hardening of the steel sheet 1 even before the marginal region 9 and, more particularly, the region 7 which will be softer enter the space between the forming tools 3, 4. Such premature hardening is undesirable when the steel sheet 1 to be formed into a formed structure should subsequently be cut to size, which is typically the case.

FIG. 4 shows a modification of the example of FIG. 3, whereby the sheet holder 8 is configured as a hold-down device which presses against the commensurately wider upper forming tool 3*a*, holding it against them marginal region 9 of the steel sheet 1. As clearly seen, the region 7, which is also partially to be made softer, is cooled via the cooling system 10 in the hold-down device 8.

Figure 5:
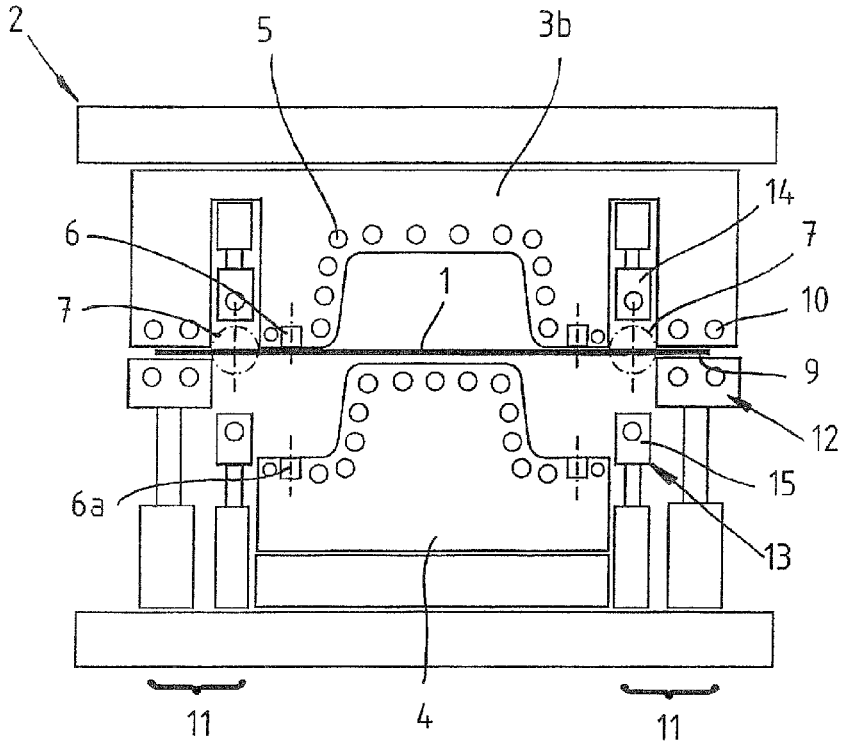
FIGS. 5 to 8 show a schematic illustration of a first embodiment of a device according to the present invention.
Figure 6:
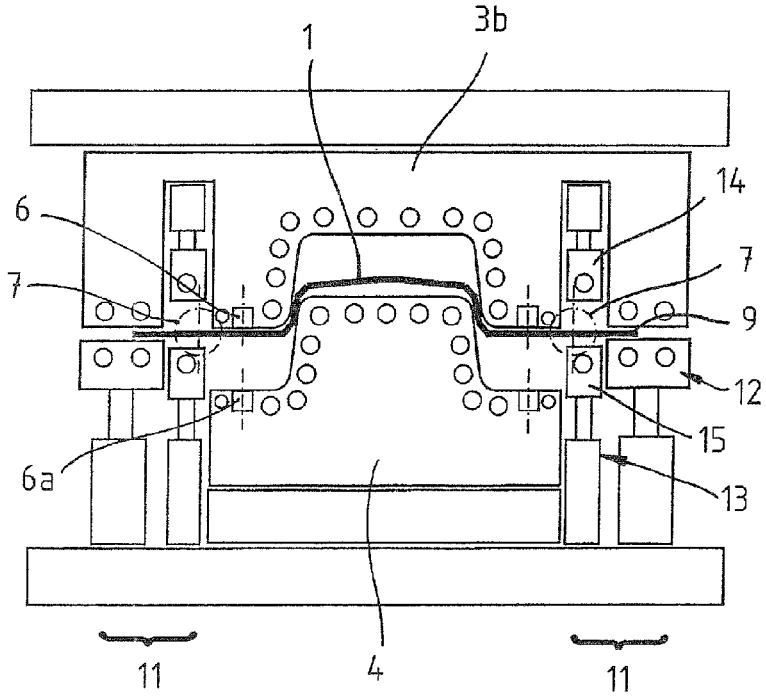
Figure 7:
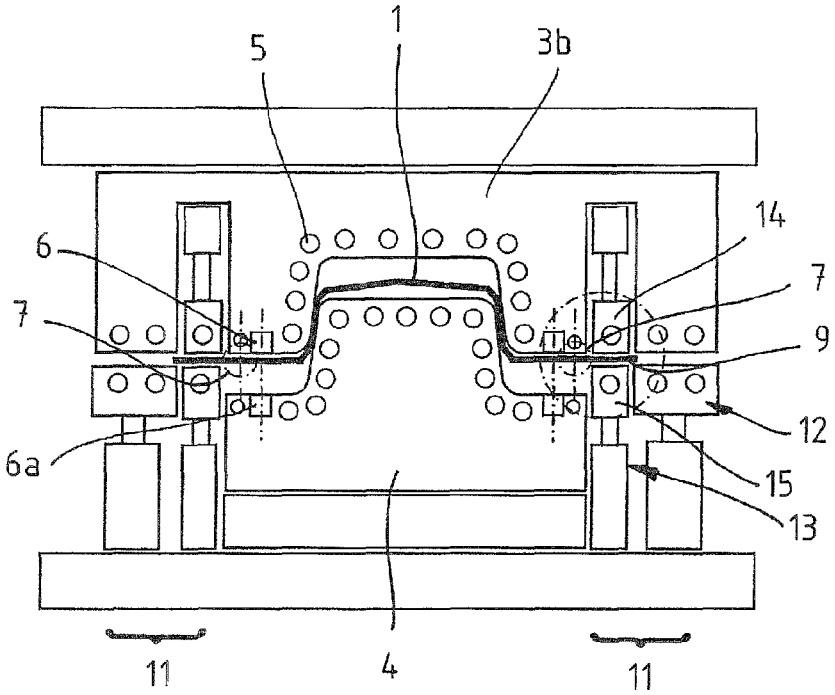
Figure 8:
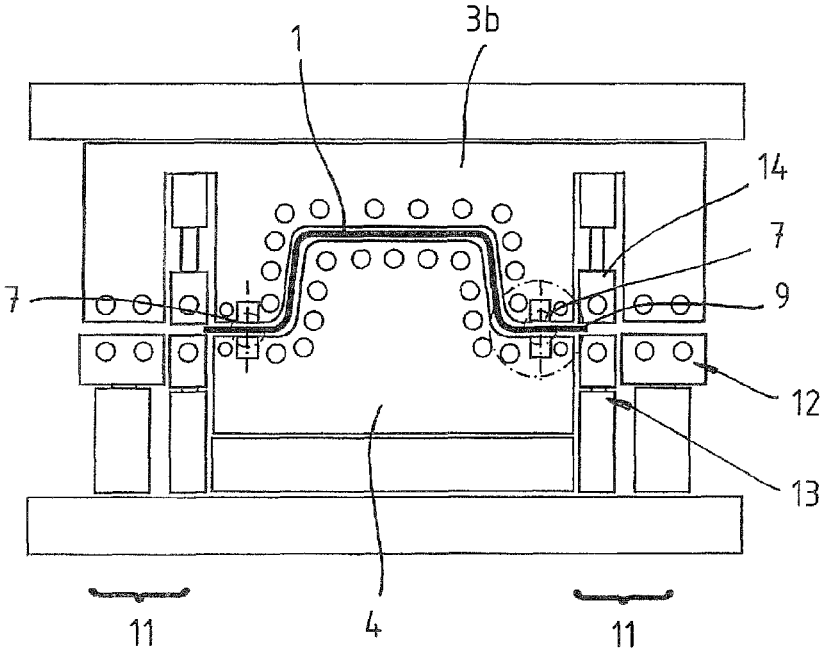
Figure 9:
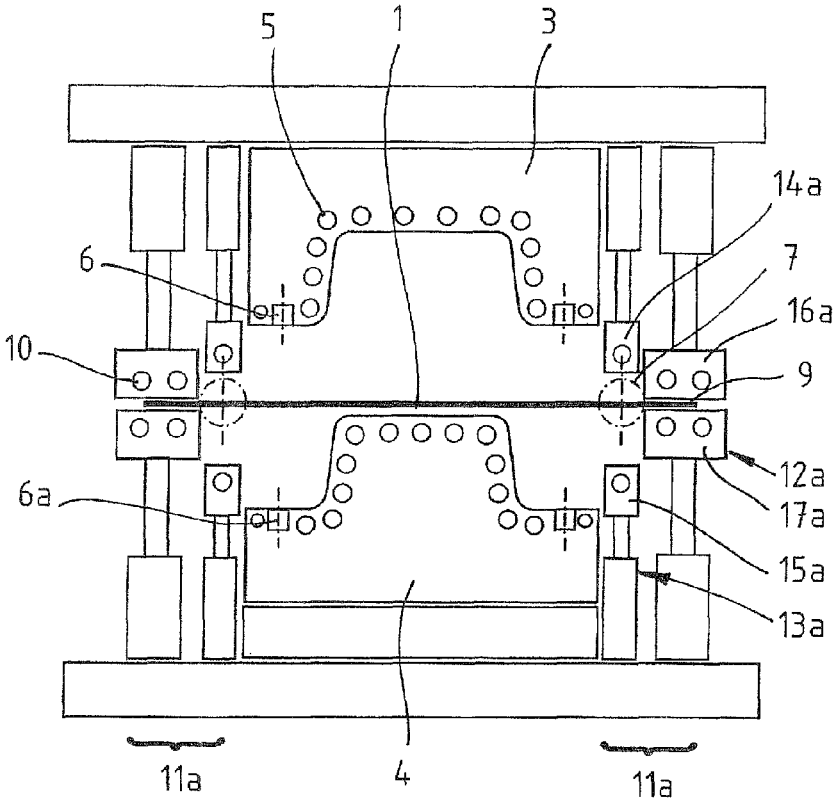
FIGS. 9 to 12 show a schematic illustration of a second embodiment of a device according to the present invention.

A first exemplary embodiment of a device in accordance with the invention is illustrated in FIGS. 5 to 8. As can be seen, a sheet holder arrangement 11 composed of an outer sheet holder 12 and an inner sheet holder 13 is associated with each of the opposing marginal regions 9 of the steel sheet 1. At the beginning of the forming process, the steel sheet 1 in FIG. 5 is held only by the outer sheet holder 12 which is cooled via a cooling system 10. As also illustrated, the region 7 to be made softer is not located in the region of the outer sheet holder 12 and is also not yet located in the contoured region of the female die 3*b*. The female die 3*b* is provided with a cooling system 5 which cools the regions contacting the steel sheet 1, thereby hardening the formed structure while the structure is still in the press tool 2. Only an uncooled contour section 6, 6*a* is left out. This contour section 6, 6*a* is either thermally isolated against cooling or is provided with an additional heater that partially heats the steel sheet 1 or keeps the steel sheet warm. Importantly, with the method of the invention, the inner sheet holder 13 does not yet make contact with the steel sheet 1 at the beginning of the forming process. This is accomplished by keeping its upper holder 14 and its lower holder 15 spaced from the steel sheet 1. As seen in FIG. 6, this position is maintained also during the forming process until the region 7, which is to be kept soft, is moved inwardly, i.e. in the direction of the female die 3*b*. The marginal region 9 of the steel sheet 1 is here still held by the outer sheet holder 12. As seen in FIG. 7, the upper and lower holders 14, 15 of the inner sheet holder 13 are moved into a holding position in order to hold the marginal region 9 which was previously still held by the outer sheet holder 12. At this time, the region 7 of reduced hardness is already inside the contour of the forming tools 3*b*, 4 and traverses during further closing of the forming tools 3*b*, 4 only a very narrow cooled region until reaching the uncooled contour section 6, 6*a*, where the region 7 is protected from excessive rapid cooling or is intentionally heated (FIG. 8). The press-hardened formed structure is subsequently removed from the press tool 2 and cut to size in the regions 7 having the reduced hardness (not illustrated).

The embodiments illustrated in FIGS. 9 to 12 differ from those of FIGS. 5 to 8 in that differently configured outer and inner sheet holders 12*a* and 13*a* are used, and also differ in the process flow.

Figure 10:
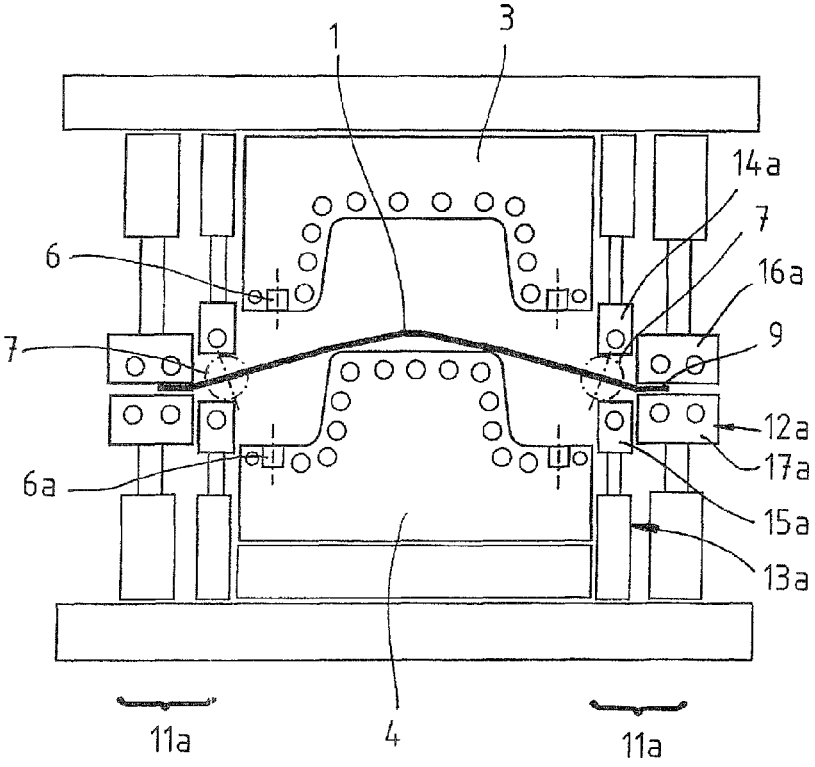

The sheet holders 12*a* and 13*a* are again composed of upper and lower holders 14*a*, 15*a* and 16*a*, 17*a*, respectively. The holders 14*a*-17*a* can be operated independently of one another. Accordingly, the outer holder 12*a* is not a hold-down device of the type illustrated in FIGS. 5 to 8. As a result, the steel sheet 1 can be arranged at the beginning of the forming process at a different distance to the female die 3 or the upper forming tool 3 and lower forming tool 4, respectively. When the female die 3 is moved towards the lower forming tool 4, the steel sheet 1 first contacts the plunger or the lower forming tool 4. This corresponds to stretch-forming of the steel sheet 1. Material can then be controllably supplied from the marginal region 9 by controlling the holding force on the outer sheet holder 12*a* (FIG. 10). Importantly, the inner hold-down device 13*a* does not yet contact the steel sheet 1, so that the region 7 of reduced hardness is not hardened before entering the forming tool 3, 4.

Figure 11:
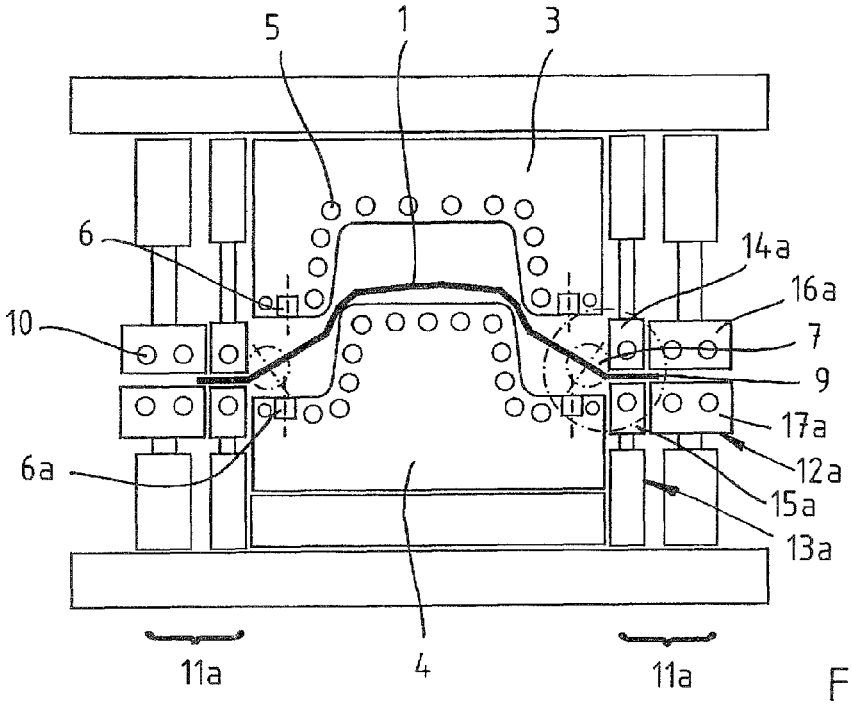
Figure 12:
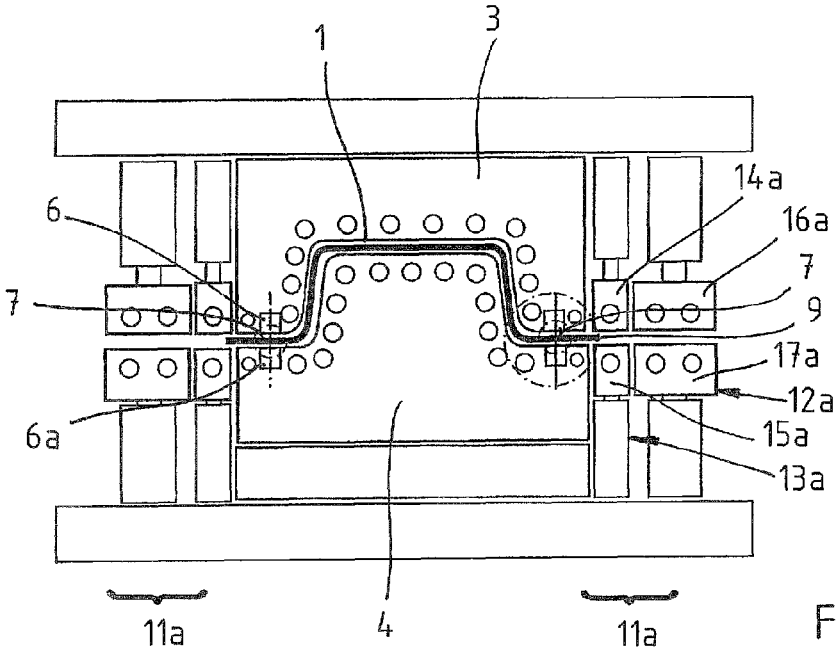

As seen in FIG. 11, by positioning the marginal region 9 of the steel structure 1 at a distance from the contour of the female die 3, the region 7 of reduced hardness contacts the female die 3 much later and undergoes almost no premature hardening. FIG. 11 also illustrates that during this forming phase, the upper holder 14*a* of the inner sheet holder 13*a* substantially fixes the marginal region 9 which was originally held by the outer sheet holder 12*a*. FIG. 12 finally shows the conclusion of the forming process, where the region 7 is located in the uncooled contour section 6, 6*a*. Once more, the formed structure is then cut to size outside the press.

Figure 13:
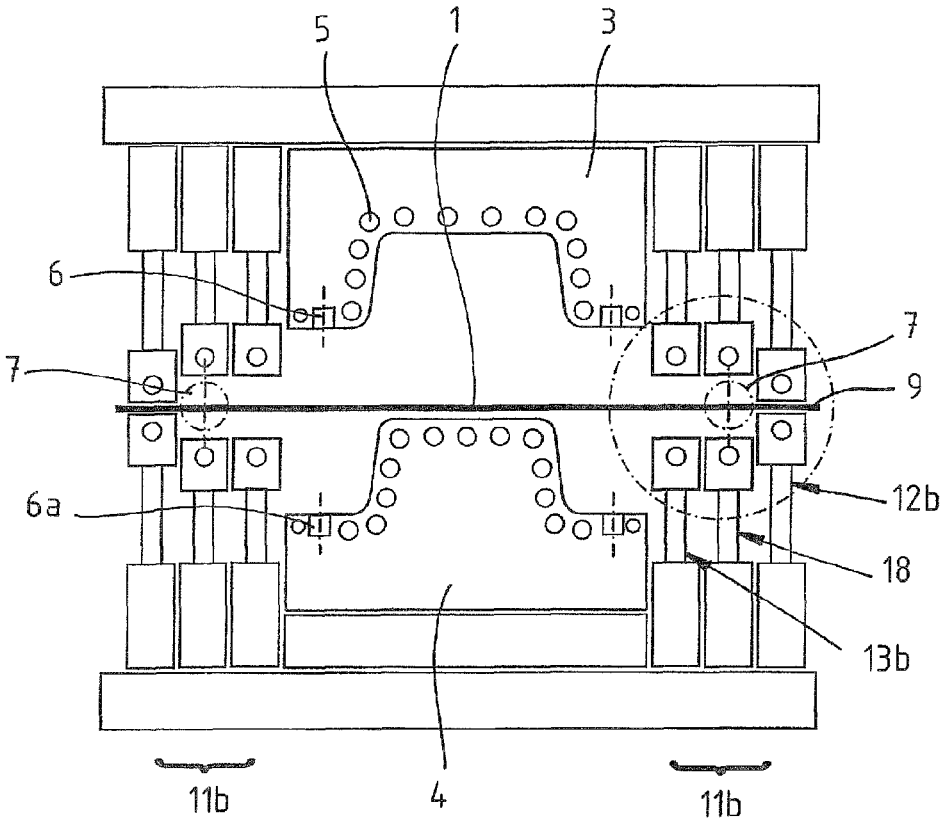
FIG. 13 shows a schematic illustration of a third embodiment of a device according to the present invention.

The embodiment of FIG. 13 is different from the preceding embodiments by employing a center sheet holder 18 in addition to an outer sheet holder 12*b* and an inner sheet holder 13*b*. The sheet holders 12*b*, 13*b* and 18 form a sheet holder arrangement 11*b*, wherein the respective upper and lower holders can be independently controlled and, as viewed from the outside to the inside, sequentially contact the marginal region 9 of the steel sheet 1 to be formed. As can be seen, the region 7 of reduced hardness is at the beginning of the forming process located in the area of the center sheet holder 18, and moves inwardly towards the female die 3 when the forming process progresses. The center sheet holder 18 is closed when the region 7 is located below the inner sheet holder 13*b*. Finally, the inner sheet holder 13*b* is closed when the region 7 is located inside the female die 3.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed is:

1. A method for press-hardening a metallic formed structure made of a hardenable steel sheet, comprising the steps of:

heating the steel sheet above a transition temperature Ac3;

placing the heated steel sheet in a cooled press tool having a forming tool with at least one uncooled contour section for forming a region of reduced hardness;

clamping marginal regions of the steel sheet with a sheet holder arrangement, said sheet holder arrangement having an inner sheet holder and an outer sheet holder, wherein the inner sheet holder is located closer to the forming tool than the outer sheet holder, said sheet holder arrangement further configured to slow down flow of the marginal regions into the forming tool; and closing the press tool to form the steel sheet at the start of the forming phase;

holding the marginal region of the steel sheet only with the outer sheet holder in a first portion of the forming phase while partially drawing the steel sheet into the press tool, and thereafter releasing the outer sheet holder and holding the marginal region of the steel sheet with the inner sheet holder in a second portion of the forming phase, while fully drawing the steel sheet into the press tool.

2. The method of claim 1, further comprising the steps of pulling the region located in the uncooled contour section out of the outer sheet holder and thereafter contacting the steel sheet with the inner sheet holder.

3. The method of claim 1, further comprising the steps of arranging at least one additional center sheet holder between the outer sheet holder and the inner sheet holder, and contacting the marginal region with the at least one additional center sheet holder after the outer sheet holder is contacted and before the inner sheet holder is contacted.

4. The method of claim 3, wherein the inner sheet holder and the outer sheet holder each comprise an upper holder and a lower holder, and wherein the upper and lower holders of the outer sheet holder are moved independent of the upper and lower holders of the inner or the center sheet holder.

5. The method of claim 3, wherein the inner sheet holder, the outer sheet holder and the center sheet holder are cooled.

6. The method of claim 3, wherein the region to be formed with reduced hardness is prevented from contacting with an inner sheet holder, an outer sheet holder or a center sheet holder, or a combination thereof.

7. The method of claim 1, further comprising the steps of arranging the region to be formed with reduced hardness outside the forming tool between the closed outer sheet holder and the forming tool before the steel sheet is formed, and drawing the region to be formed with reduced hardness into the forming tool while the steel sheet is formed, while holding the inner sheet holder in an open position.

8. The method of claim 1, wherein the inner sheet holder is closed when the region to be formed with reduced hardness is located outside the inner sheet holder and is drawn into the forming tool.

9. The method of claim 1, further comprising the step of cutting the press-hardened formed structure to size, wherein the cut edge is located at least partially in the region of reduced hardness.

* * * * *